United States Patent [19]

Ducasse

[11] 4,150,860

[45] Apr. 24, 1979

[54] FILING SYSTEM FOR VERTICALLY SUPPORTING DOCUMENTS

[76] Inventor: Joseph C. V. Ducasse, 391 Donegal Pl., Martinez, Calif. 94553

[21] Appl. No.: 797,852

[22] Filed: May 17, 1977

Related U.S. Application Data

[63] Continuation-in-part of Ser. No. 722,219, Sep. 10, 1976, abandoned.

[51] Int. Cl.[2] ..... A47B 63/00; G09F 3/16

[52] U.S. Cl. ..... 312/184; 312/306; 312/312; 40/11 A

[58] Field of Search ..... 312/184, 185, 247, 312, 312/131, 306; 40/11 A, 23 A; 24/129 R; 313/184, 183

[56] References Cited

U.S. PATENT DOCUMENTS

| | | | |
|---|---|---|---|
| 484,902 | 10/1892 | Smith | 40/11 A |
| 747,761 | 12/1903 | Pollard | 40/23 A |
| 923,412 | 6/1909 | Dannheiser | 312/184 |
| 1,045,557 | 11/1912 | Ilges | 312/184 |
| 1,354,973 | 10/1920 | Hicks | 312/312 |
| 1,851,770 | 3/1932 | Johnson | 40/11 A |
| 1,927,578 | 9/1933 | Thompson | 40/11 A |
| 2,962,335 | 11/1960 | Benson | 312/184 |
| 3,123,924 | 3/1964 | Roberts | 40/11 A |
| 3,556,507 | 1/1971 | Haskell | 24/129 R |
| 3,582,173 | 6/1971 | Noren | 312/312 |
| 3,950,050 | 4/1976 | Kinder | 312/306 |

*Primary Examiner*—Victor N. Sakran
*Attorney, Agent, or Firm*—Wenderoth, Lind & Ponack

[57] ABSTRACT

A filing cabinet includes a supporting frame assembly which is attachable to a supporting structure, such as a wall, a document support assembly attached to the supporting frame assembly, a plurality of document clip members having hooks mounted on the document support assembly for vertically suspending therefrom documents to be stored, and a movable cover assembly mounted on the supporting frame assembly and movable between a closed position enclosing documents suspended from the document clip members and an open position spaced from such documents.

5 Claims, 7 Drawing Figures

FILING SYSTEM FOR VERTICALLY SUPPORTING DOCUMENTS

This is a continuation-in-part of application Ser. No. 722,219, filed Sept. 10, 1976, now abandoned.

BACKGROUND OF THE INVENTION

The present invention relates to a novel filing cabinet for vertically suspending documents to be stored.

Conventional filing cabinets are normally of the type including one or a plurality of horizontally movable drawers wherein are filed various documents. Removal and insertion of documents from such file drawers are however quite often inconvenient.

The present invention further relates to a novel document clip member, generally of the paper clip type.

SUMMARY OF THE INVENTION

Accordingly, the primary object of the present invention is to provide a filing system including a filing cabinet of the type which is capable of vertically suspending documents.

A further object of the present invention is to provide such a filing cabinet wherein documents may be easily inserted and removed, as well as inspected.

A still further object of the present invention is to provide a filing system including a novel document clip member comprising a clip portion similar to a conventional paper clip as well as an open-sided hook portion formed integrally with the clip portion.

It is a still further object of the present invention to provide such a novel clip member which may be readily hung on or removed from a rod or peg supported at both opposite ends thereof or alternatively supported in a cantilevered fashion from only one end thereof.

The above objects are achieved in accordance with the present invention by the provision of a filing system including a filing cabinet including a supporting frame assembly including upright members which are attached to a supporting structure, such as a wall. The upright members have therein vertical slots. A connecting member connects the upright members and supports a plurality of arms which extend outwardly from the connecting member. The arms support at least one horizontal rod. Document clip members, which themselves each form a filing system according to the invention, each have a hook suspendable over the rod. The clip members are otherwise similar to paper clips and grasp various documents to be stored, such documents thereby being suspended from the rod. A movable cover assembly includes side walls each having attached thereto at least one roller which rides in the vertical slot of one of the upright members. Tension springs urge the cover vertically upwardly to an open position away from any documents supported by the clip members. The cover is manually movable downwardly against the tension of the springs to a closed position enclosing such documents.

BRIEF DESCRIPTION OF THE DRAWINGS

Other objects and features of the invention will be apparent from the following detailed description of preferred embodiments thereof, with reference to the attached drawings, wherein.

DETAILED DESCRIPTION OF THE INVENTION

Figure 1:
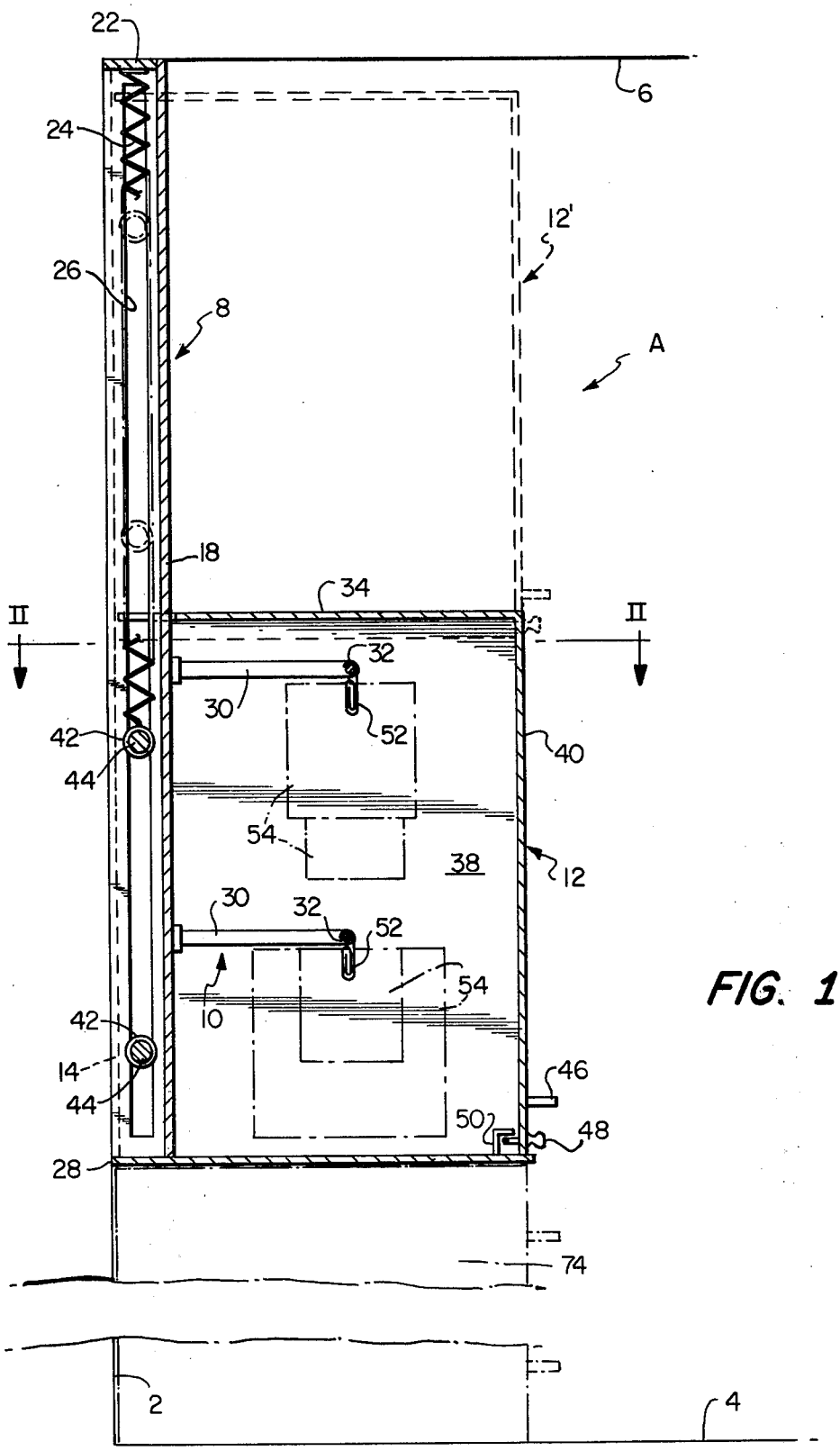
FIG. 1 is a cross-sectional side view, taken along line I—I of FIG. 2, of one embodiment of a filing system in the form of a filing cabinet in accordance with the present invention.

With reference now to the drawings, preferred embodiments of the novel filing system of the present invention will be described. It is to be understood that various dimensions of various of the elements shown in the drawings have been distorted therein for purposes of clarity of illustration.

Figure 2:
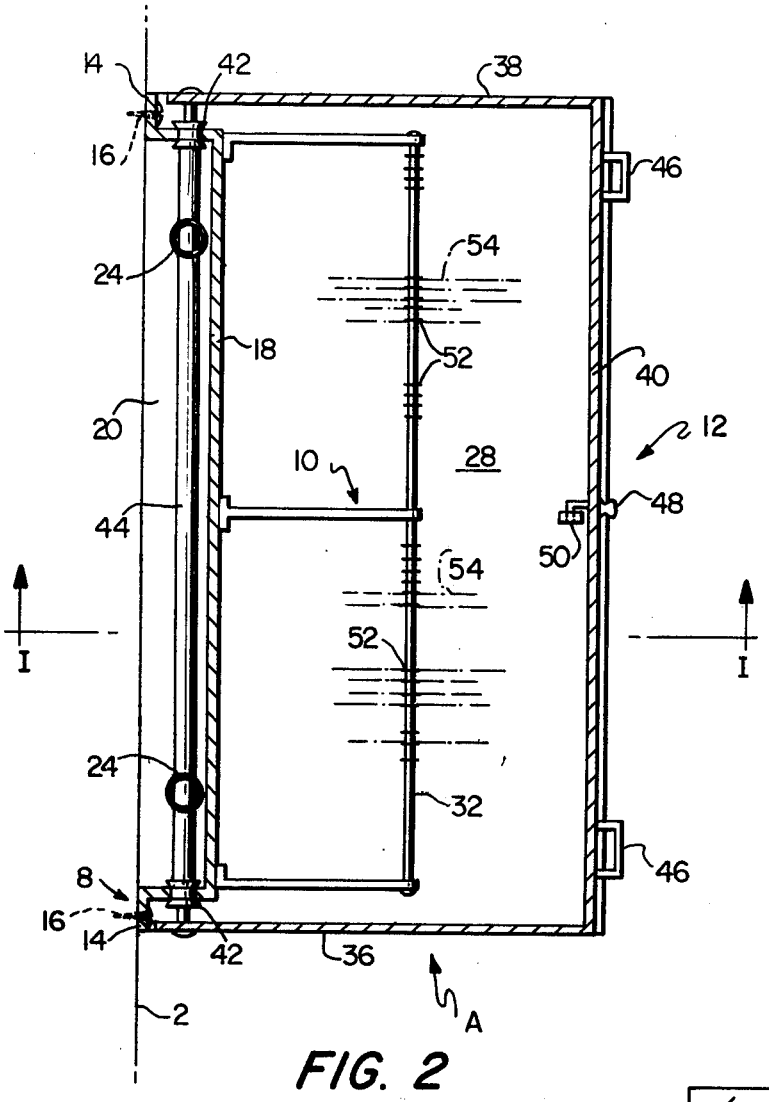
FIG. 2 is a horizontal cross-sectional view of the filing cabinet taken along line II—II of FIG. 1.
Figure 4:
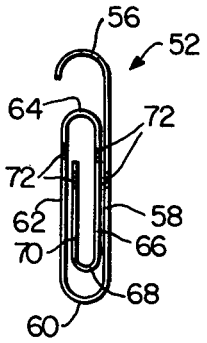
FIG. 4 is an enlarged elevation view of a document clip member constituting another embodiment of the invention.
Figure 3:
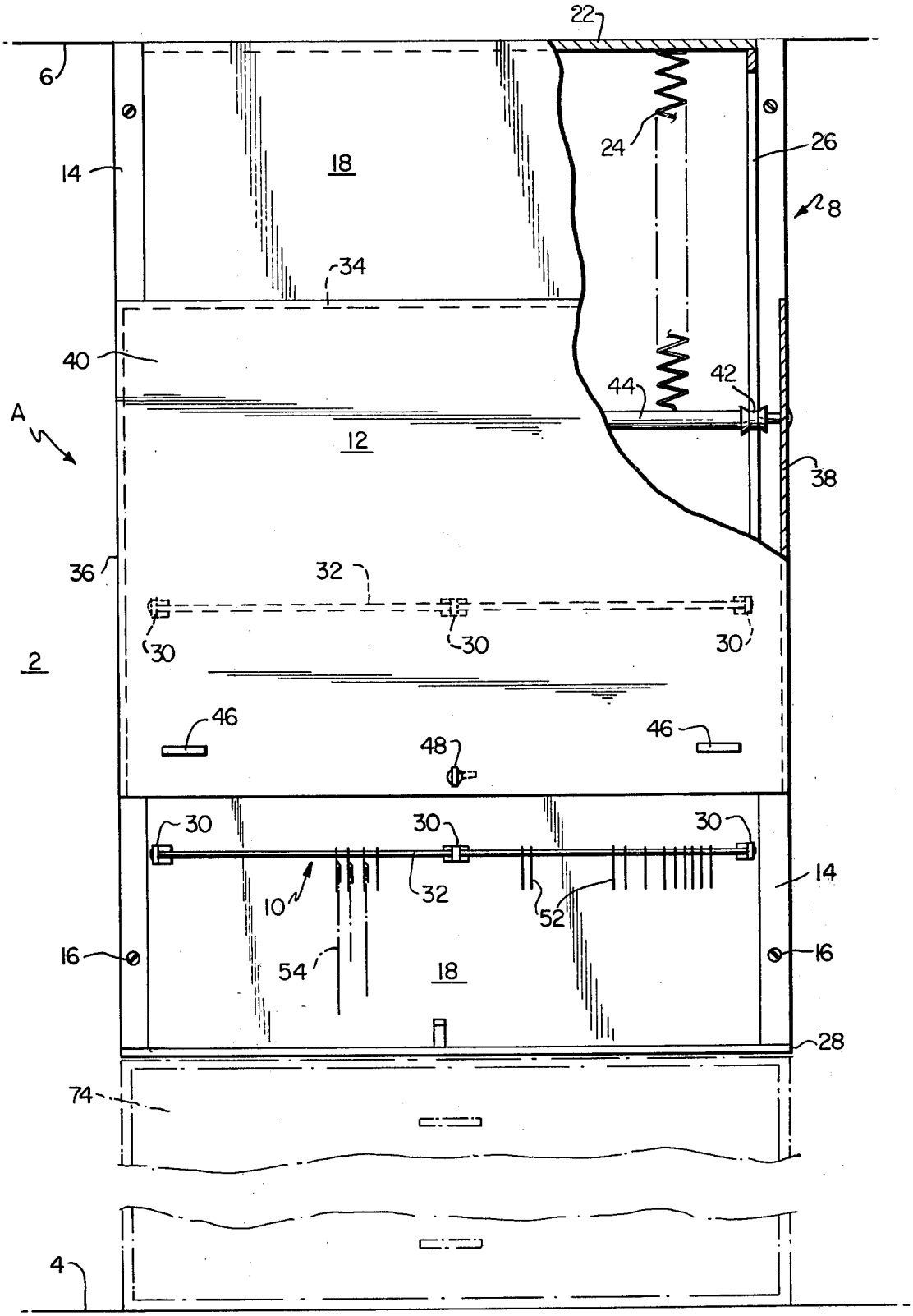
FIG. 3 is a front view, as viewed from the right in FIG. 1, of the filing cabinet, but with the movable cover assembly thereof partially raised, and with a portion of the filing cabinet broken away for clarity of illustration.

With reference initially to FIGS. 1–3, a filing cabinet A, according to a first embodiment of the invention, is mounted on a wall 2 between a floor 4 and a ceiling 6 as shown. The filing cabinet generally includes a cabinet supporting frame assembly 8, a document support assembly 10, and a movable cover assembly 12.

The filing cabinet supporting frame assembly 8 includes a pair of vertical upright members 14, each having a substantially L-shaped cross-section. Vertical upright members 14 are attached to wall 2 by any suitable fasteners, for example screws 16. The outer edges of vertical upright members 14 are joined by a connecting member such as a vertical plate 18. In the illustrated embodiment, the two vertical upright members 14 and the vertical plate 18 are shown as being an integral element. Such element could be easily formed from a single piece of material, for example a single piece of appropriately folded sheet metal. It is however to be understood that the vertical upright members 14 may be formed separately from vertical plate 18 and then attached thereto by any suitable fasteners. Furthermore, each vertical upright member 14 is shown as an integral member having a first flange parallel and attached to wall 2, and a second flange extending outwardly from wall 2. It should however be understood that these two flanges could be separately formed and then joined by suitable fastener members. It will be further understood that vertical upright members 14 need not be of the illustrated L-shaped configuration, but rather could be of any other desirable configuration affording means for attachment to wall 2 and further affording a surface extending outwardly from the wall. Additionally, vertical plate 18 is shown as being solid, i.e. it extends completely between vertical upright members 14, thereby forming with wall 2 and vertical upright members 14 a substantially enclosed space 20. However, it should be understood that the functional purpose of element 18 is only to provide support for fixedly positioned document support assembly 10. It will be apparent to those skilled the art that element 18 could take many other configurations capable of achieving this function without being in the form of a plate.

Filing cabinet supporting frame assembly 8 also may include an upper horizontal plate 22 attached to ceiling 6 and providing attachment support for spring assemblies 24, the purpose of which will be discussed in more detail below.

Those flanges of each vertical upright member 14 which extend perpendicularly to wall 2 have formed therein continuous vertical slots 26, the purpose of which will be discussed in more detail below.

The filing cabinet supporting frame assembly 8 also includes a bottom plate 28 which provides an abutment surface for movable cover assembly 12 when in the closed position thereof.

The document support assembly 10 is fixedly attached to the filing cabinet supporting frame assembly 8. In the illustrated embodiment, document support assembly 10 is attached to vertical plate 18. As discussed above however, it will be understood that document support assembly 10 could be attached in any suitable manner to various above discussed elements of the filing cabinet supporting frame assembly 8. In the illustrated embodiment, document support assembly 10 is permanently fixedly attached to vertical plate 18. It should however be understood that the attachment of document support assembly 10 may be made in an adjustable manner by means of mechanical expedients which would be understood to those skilled in the art.

The document support assembly 10 includes a plurality of vertically spaced document nesting positions or levels. In the illustrated embodiment, two such nesting positions or levels are shown, each being formed by a row of supporting arms 30 projecting outwardly from vertical plate 18 and by a horizontally extending rod 32 supported by the respective arms 30. It is however to be understood that there could readily be provided only one nesting position including a row of arms 30 and rod 32, or more than two such nesting positions. Furthermore, it should be understood that although each nesting position in the illustrated embodiment includes three supporting arms 30, only two such arms or more than three such arms could readily be employed. It will be apparent that the vertical spacing between rows of arms 30 will be sufficient to accommodate the length of any documents supported from rods 32, in a manner to be described in more detail below.

Movable cover assembly 12 includes a cover or shield member including an upper wall 34, spaced side walls 36 and 38, and front wall 40. The rear and bottom portions of the cover are open.

Attached to each of side walls 36 and 38, at positions adjacent the free ends thereof closest to wall 2, are rollers 42 which ride in respective vertical slots 26 of respective vertical upright members 14. In the illustrated embodiment two vertically spaced rollers 42 are mounted interiorly on each side wall 36 and 38 of the cover. It is to be understood however that each side wall of the cover could have attached thereto a number other than two of rollers 42. In the illustrated embodiment each pair of horizontally spaced rollers 42 are connected by a horizontal brace 44, for example in the form of an axle.

The movable cover assembly also includes means for urging the cover upwardly from the closed position shown by the solid lines in FIG. 1 to the open position thereof indicated by reference numeral 12' and shown in dashed lines. In the illustrated embodiment, this function is achieved by the above mentioned coiled tension springs 24, opposite ends of which are attached to upper horizontal plate 22 and to the uppermost brace 44 connecting the uppermost rollers 42. Accordingly, the tension force of springs 24 urge upper brace 44 upwardly. This causes rollers 42 to move upwardly along slots 26, thus moving the cover upwardly.

It will be apparent to those skilled in the art that springs 24 could have a configuration other than a coiled configuration as illustrated. It will further be apparent that springs 24 could be otherwise attached, both to the filing cabinet supporting frame assembly and to the movable cover assembly to achieve the application to the movable cover asembly of an upward force. For instance, compression springs could be positioned between bottom plate 28 and the lower brace 44 to thereby urge the cover upwardly. It will be still further apparent that the upward urging of the cover could be achieved by means other than tension or compression springs. For example, cables could be attached at one end thereof to the uppermost brace 44, extend over pulleys mounted on top plate 22, and have attached to second ends thereof weights sufficient to urge the cover upwardly. It will be even further apparent that other structural means for urging the cover upwardly will be apparent to those skilled in the art.

The cover has provided thereon, for example on the lower portion of front plate 40, handles 46, as well as a latch or lock control mechanism 47. Lock control mechanism 48 is provided so that when the handles 46 are grasped to pull the cover downwardly from the open position shown in dashed lines in FIG. 1 to the closed position shown in solid lines, manipulation of lock mechanism 48 will cause the cover to be retained in the closed position. Lock mechanism 48 may be any conventional known locking or latching mechanism. In the illustrated embodiment locking mechanism 48 is rotatably mounted in front plate 40 and has in the interior of the cover an L-shaped hook which may be rotated into and out of engagement with a catch 50 provided on bottom plate 28.

A plurality of documents may be suspended vertically from rods 32 by means of document clip members 52, constituting another embodiment of the invention. In FIGS. 1–3 of the drawings, each rod 32 is shown as supporting a plurality of clip members 52, and some of these clip members are shown as supporting documents 54.

Figure 5:
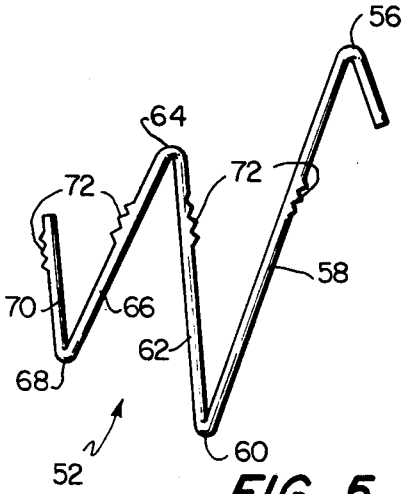
FIG. 5 is a side view of the document clip member of FIG. 4, but with the clip member stretched apart to illustrate certain structural features thereof.
Figure 6:
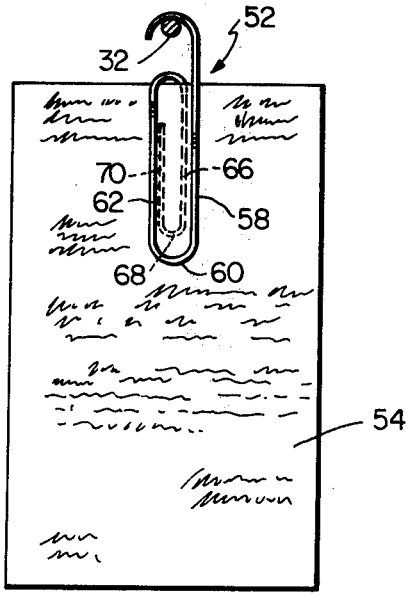
FIG. 6 is an elevation view illustrating the document clip member of FIG. 4 supporting a document from the document support assembly of FIGS. 1–3.

Each document clip member 52 preferably has a construction similar to that of a conventional paper clip, but with the addition of an upper hook 56. Hook 56 has depending downwardly therefrom a longitudinal portion 58 joined by a bend 60 to an upwardly extending longitudinal section 62, which is in turn joined by a bend 64 to a further downwardly extending longitudinal portion 66, which in turn is joined by a further bend 68 to an additional upwardly extending portion 70. Hook 56 fits over rod 32 as shown in FIG. 6. As further shown in FIG. 6, the document clip member has a configuration such that longitudinal portion 58, bend 60, and longitudinal portion 62 grasp one side of a document 54, while longitudinal portion 66, bend 68 and longitudinal portion 70 form a section which grasps the opposite side of document 54. As shown particularly in FIG. 5, which shows a document clip member 52 in a stretched condition as would be achieved by pulling longitudinal portion 70 leftwardly and hook 56 rightwardly, the document engaging surfaces of each of the longitudinal portions 58, 62, 66 and 70 have therein serrations or burred portions 72, such as are provided in known paper clips. Serrations 72 facilitate grasping of document 54.

It will be readily apparent from the above discussion and FIGS. 1–3 of the drawings that in the first embodiment of the invention, when the cover is moved to the open position thereof, selected of the documents suspended within the filing cabinet may be removed or additional documents may be inserted into unused document clip members 52 and thereby suspended.

In the illustrated arrangement, the filing cabinet is spaced from the floor 4, so as to present documents 54 at a convenient height, and a conventional file cabinet 74 is positioned beneath the novel filing cabinet of the present invention. However, it is to be understood that the specific vertical positioning and/or dimensions of the filing cabinet of the present invention may be provided as desired for a given operation.

The embodiment of the present invention discussed above with regard to FIGS. 1–3 of the drawings is particularly advantageous when storing important documents or when a great many documents are to be stored.

However, as mentioned above, it is intended that a further embodiment of the present invention be constituted by the document clip members 52 themselves.

Specifically, document clip members 52, having a structure discussed above, are themselves novel in configuration and use. That is, document clip member 52 includes a conventional paper clip type clip portion as well as hook portion 56. The document clip member 52 thus offers the advantages of not only being serviceable as a normal paper clip, but also being readily storable by being easily hung on or removed from a rod or peg. More particularly, it is contemplated that a second embodiment of the present invention be encompassed by document clip member 52 including a clip portion and an open-sided hook portion 56 integral with the clip portion.

The advantages of document clip member 52 will be readily apparent from a consideration of FIG. 2 of the drawings. Specifically, and as discussed above, due to the open-sided hook portion 56 of document clip member 52, the document clip member may be readily hung on or removed from rod 32. It will of course be apparent and understood that a normal paper clip could not be suspended from rod 32 without disassemblying the paper clip or removing rod 32 from arm 30. Specifically, conventional paper clips could be suspended from a rod only by inserting the paper clips over an end of the rod.

Figure 7:
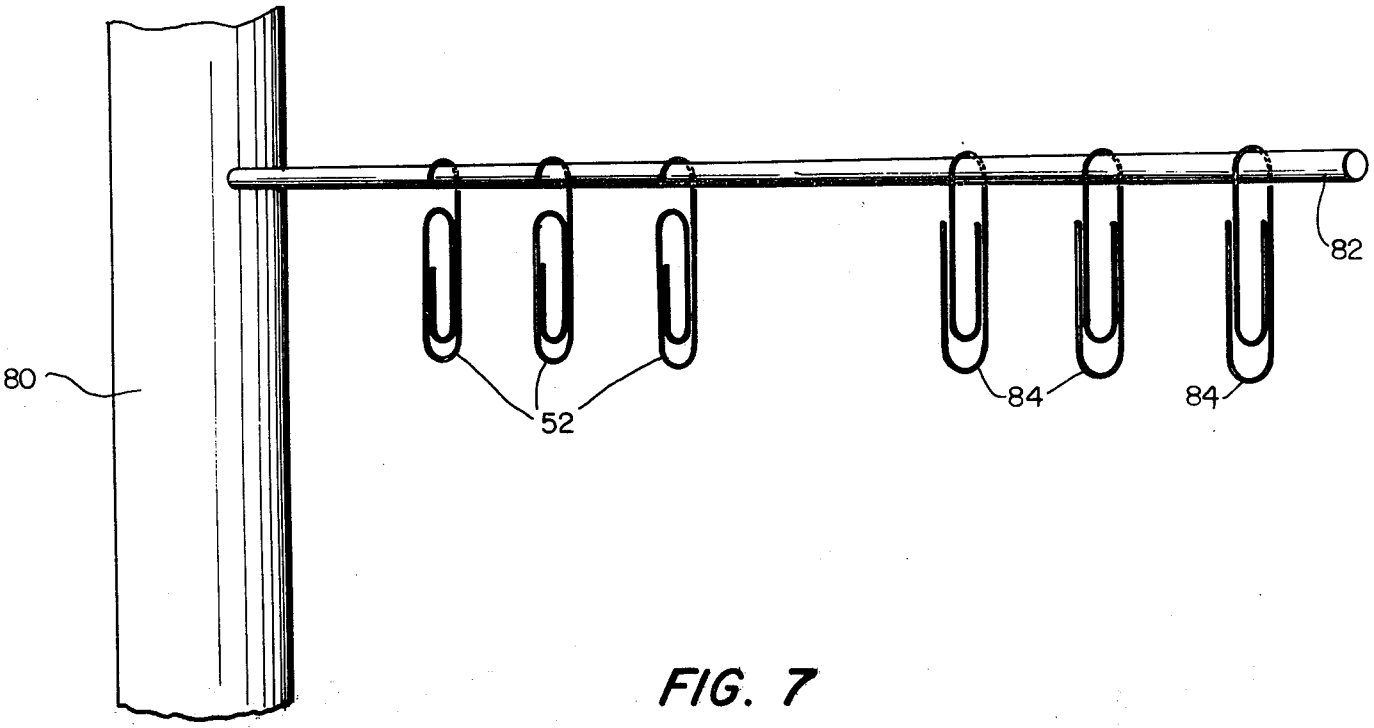
FIG. 7 is a perspective view of a still further embodiment of the present invention and illustrating the advantages of the document clip member of the invention as compared with a conventional paper clip.

The advantages of the document clip member 52 will be further apparent from a consideration of FIG. 7 of the drawings which also illustrate a further embodiment of the present invention.

Specifically, in FIG. 7 there is shown a substantially horizontal rod 82 which may be cantilevered from a single support 80 or which may be supported at both ends thereof by supports, similar to rod 32 being supported by arms 30 in FIG. 2. When rod 82 is a cantilevered rod, then conventional paper clips 84 may be inserted seriatim over the free end of rod 82. When a given conventional paper clip 84 is to be removed, then all paper clips or document clip members between such given paper clip and the free end of rod 82 must first be removed, and then the given paper clip may be removed.

However, it will be apparent that given document clip members 52 may be readily hung on or removed from rod 82 without disturbing any other document members suspended from rod 82.

Accordingly, it is contemplated that a third embodiment of the present invention include a substantially horizontally supported rod, either supported in a cantilevered fashion from one end thereof, or supported at both ends thereof, and a plurality of document clip members suspended therefrom, each document clip member including a clip portion for gripping and supporting documents and an open-sided hook protion integral with the clip portion.

Although specifically preferred embodiments of filing systems according to the present invention have been described and illustrated, it is to be understood that various modifications to the specifically described and illustrated structural arrangements may be made without departing from the scope of the present invention.

What is claimed is:

1. A document filing cabinet system for vertically suspending documents in side-by-side relationship, said system comprising:

a fixedly positioned vertically extending supporting frame;

at least one arm fixedly attached to said frame and extending outwardly therefrom;

a fixedly positioned rod supported substantially horizontally by said arm; and at least one document clip member in the form of a single integral device including a clip portion having a paper clip configuration for elastically gripping opposite sides of at least one document, and an open-sided hook integral with and extending from said clip portion, said clip portion and said hook being substantially entirely coplanar, said hook being spaced from said clip portion by a distance greater than the transverse size of said rod.

2. A document filing cabinet system as claimed in claim 1, wherein said hook has extending therefrom a first longitudinal portion joined by a first bend to a second longitudinal portion which extends from said first bend toward said hook, said second longitudinal portion is joined by a second bend to a third longitudinal portion which extends from said second bend away from said hook, said third longitudinal portion is joined by a third bend to a fourth longitudinal portion which extends from said third bend toward said hook, and said hook, said first, second, third and fourth longitudinal portions and said first, second and third bends being arranged to extend in a common plane.

3. A document filing cabinet system as claimed in claim 1, comprising a plurality of said rods fixedly supported by a plurality of said arms in vertically spaced relationship.

4. A document filing cabinet system as claimed in claim 1, wherein said frame has in opposite lateral sides thereof vertically extending slots, and further comprising a movable cover assembly including an upper wall, opposite side walls, and a front wall, each of said opposite side walls having fixed thereto at least one roller which fits in a respective said vertically extending slot, said movable cover assembly being vertically movable with respect to said frame between a lower closed position enclosing documents suspended from said document clip member and an upper open position spaced vertically above such documents, and spring means positioned between said frame and said movable cover assembly for urging said movable cover assembly to said upper open position thereof.

5. A document filing cabinet system as claimed in claim 1, wherein said rod is supported by a plurality of said arms.

* * * * *